US007100594B2

(12) United States Patent
Boehner

(10) Patent No.: US 7,100,594 B2
(45) Date of Patent: Sep. 5, 2006

(54) TENNIS BALL SERVING DEVICE

(76) Inventor: Douglas L. Boehner, P.O. Box 9330, Truckee, CA (US) 96132

( * ) Notice: Subject to any disclaimer, the term of this patent is extended or adjusted under 35 U.S.C. 154(b) by 892 days.

(21) Appl. No.: 09/781,530

(22) Filed: Feb. 8, 2001

(65) Prior Publication Data

US 2002/0104525 A1 Aug. 8, 2002

(51) Int. Cl.
*F41B 4/00* (2006.01)

(52) U.S. Cl. ..... 124/78

(58) Field of Classification Search ..... 124/6, 124/78

See application file for complete search history.

(56) References Cited

U.S. PATENT DOCUMENTS 3,785,358 A * 1/1974 D'Angelo et al.
4,442,823 A * 4/1984 Floyd et al. ..... 124/78
5,125,653 A * 6/1992 Kovacs et al. ..... 124/78 X
5,964,209 A * 10/1999 Boehner ..... 124/78
6,237,583 B1 * 5/2001 Ripley et al. ..... 124/78

* cited by examiner

*Primary Examiner*—John A. Ricci
(74) *Attorney, Agent, or Firm*—Sierra Patent Group, Ltd.

(57) ABSTRACT

Tennis balls are propelled to a person practicing the game. The balls are propelled by a head that is vertically repositionable and horizontally aimable. The apparatus includes a main frame, including an attached control box, having a dual hinge; a deformable parallelogram lifting arm, having a first end and a second end, attached at its first end to the dual hinge on the main frame; a movable vertically extending member, rotatably receiving and supported by the second end of the lifting arm at a first end; an oscillating bracket, disposed at a second end having at least one upwardly extending arm, rotatable around a vertical axis; a ball propulsion device mounted on the oscillating bracket to be horizontally rotatable; and a feed support attached to the oscillating bracket above the ball propulsion device providing a source of balls for the ball propulsion device.

23 Claims, 5 Drawing Sheets

TENNIS BALL SERVING DEVICE

BACKGROUND OF THE INVENTION

1. Field of the Invention

This invention relates to apparatus to provide practice in ball games; in particular, this invention relates to devices to propel tennis balls to players trying to improve their game.

2. State of the Art

Games that involve balls frequently require that athletes playing those games have expertise and coordination with the balls used for that game. It is difficult to achieve the needed degree of expertise and coordination in normal practice with human opponents because humans tire and are not consistent in their throws or serves and the like. Moreover, the players at the higher leaves cannot find challenging enough practice players to improve their own play. This is especially true in the case of the higher end versions of the sports, for example, professional and college or Olympic levels of amateur sports. Therefore, a variety of devices that aid in the practice of handling the balls are in use.

The variety of devices known and patented for propelling balls for practice include, U.S. Pat. No. 3,794,001, issued Feb. 26, 1074, which teaches a device that propels tennis balls from two opposed wheels, one of which is driven the other has a braking mechanism to provide some degree of spin in the vertical plane.

Similarly, U.S. Pat. No. 4,325,351, issued Apr. 20, 1982 teaches a device that has two driven wheels and a nozzle to aim the ball emerging therefrom.

U.S. Pat. No. 4,442,823, issued Apr. 17, 1984, teaches a three-wheel pitching machine. The wheel frame is particularly robust, and effectively hides the operation from the sight of the user.

U.S. Pat. No. 4,712,534, issued Dec. 15, 1987, teaches a two-opposing-wheel ball throwing machine.

U.S. Pat. No. 4,841,945, issued Jun. 27, 1989, teaches a device specific for tennis having two driven wheels and a tall frame. The device features a complex ball delivery device to feed the driving wheels.

U.S. Pat. No. 5,649,523, issued Jul. 22, 1997, teaches a device having three driven wheels to propel a ball. The driving wheels are pivotally mounted allowing them to sweep in a vertical direction, while the ball feeder mechanism is firmly mounted on a fixed frame.

Finally, U.S. Pat. No. 5,865,161, issued Feb. 2, 1999, teaches another approach to the mounting of three wheels to provide a means to propel balls fast and with spin. It includes a tall frame that does not allow easy movement of the ball throwing head of the apparatus.

It can be seen that tennis is a game where practice devices are frequently used. The problems that impede the design of such devices can be seen from the prior art and its attempts to solve the problems. One is serving the balls fast enough to be a realistic mimic of balls that are served at the highest levels of competitive tennis. Another is the problem of allowing ready aiming of the ball while simultaneously serving the balls. And finally, there is the problem of imparting spin to the tennis balls in all directions, to allow top spin, bottom spin, and left and right spin. These devices can allow the balls to be propelled over the net for the player to practice hitting back, either for practice serves or for practicing volleys. Most of these devices now known are set on the ground. Recently some of the devices have placed the ball propulsion device higher for more realistic serves, but it can be seen that the propelling heads are frequently not readily movable. Moreover, feeding the balls to the propelling head is a cumbersome and tricky problem.

Therefore, more realistic and accurate serving devices, allowing the ball to be served faster, higher in the air, at more angles of attack, and at a variety of angels that are readily changeable during practice, while imparting spin in any direction to the ball, would be of great benefit to those practicing the game of tennis.

SUMMARY OF THE INVENTION

This invention provides a device for propelling tennis balls to a person practicing the game. The balls are propelled by a head that is vertically repositionable and horizontally aimable.

A first aspect of this invention is an apparatus for propelling balls for game practice comprising:

a base member contacting a fixed support member having an integral vertically extending member, the vertically extending member terminating in a first dual hinge;

a lifting arm, including an upper elongate member having a first end and a second end and a lower elongate member having a first end and a second end, the upper elongate member attached to the first dual hinge at a first end and the lower elongate member rotatably attached to the first dual hinge at a first end, the upper elongate member and the lower elongate member mounted substantially parallel to each other;

a compression resistant member having a first end and a second end, the first end attached to the base member and the second end attached to the lower member of the lifting arm;

a movable vertically extending member having a second dual hinge, the second dual hinge rotatably attached to the second end of the upper elongate member and rotatably attached to the second end of the lower elongate member, such that the upper elongate member, the lower elongate member, the first dual hinge and the second dual hinge form a deformable parallelogram that maintains the orientation of the vertically extending member relative to the base member;

an oscillating bracket rotatable about the vertical axis attached to the movable vertically extending member;

a ball propulsion device supported by and rotatable about a horizontal axis attached to the serving head support bracket; and a ball delivery guide feeding balls to the ball propulsion device mounted on the serving head support bracket.

A second aspect of this invention is an apparatus for propelling balls for game practice comprising:

a main frame, including an attached control box, having a dual hinge;

a deformable parallelogram lifting arm, having a first end and a second end, attached at its first end to the dual hinge on the main frame;

a movable vertically extending member, rotatably receiving and supported by the second end of the lifting arm;

an oscillating bracket, having at least one upwardly extending arm, rotatable around a vertical axis;

a ball propulsion device mounted on the oscillating bracket to be horizontally rotatable; and feed support attached to the oscillating bracket above the ball propulsion device providing a source of balls for the ball propulsion device.

DETAILED DESCRIPTION OF THE PREFERRED EMBODIMENT

Figure 1:
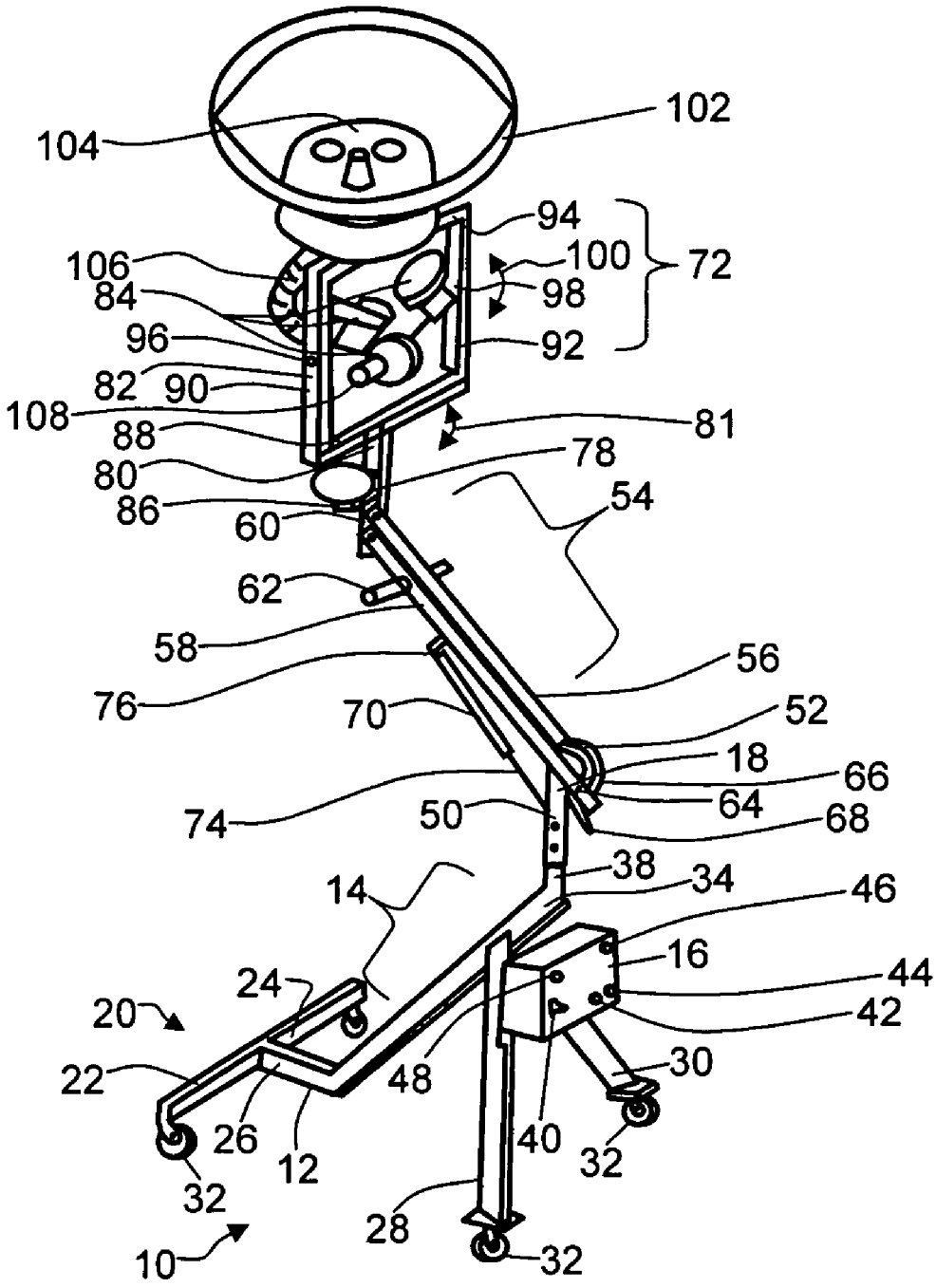
FIG. 1 shows a perspective view of a preferred embodiment of the present invention fully vertically extended.

Referring to FIG. 1, an apparatus for propelling balls 10 for game practice is shown fully vertically extended. The embodiment shown is mostly useful for propelling tennis balls on a tennis court. The concept of this invention can be used to propel any spherical ball used for playing games, including those used for tennis, volleyball, baseball, handball, racquet ball, and the like. The structure of the device must be made robust enough to propel the ball used in the sport at a speed useful for practicing that game.

As shown in FIG. 1, the apparatus for propelling balls 10 is supported by a base member 12. The base member may be movable, as shown, or it may be permanently affixed to the surface. The base and the associated structure, comprising a main frame 14, and an attached control box 16, terminate in a first dual hinge 18. The base member has a "T" support member 20, the "T" provides essentially one of three supports in a tripod support, however the cross member of the "T" 22 is provided for extra support. A foot plate 24 is mounted between the cross member of the "T" support and the middle member of the "T" 26. The remaining legs of the tripod support include a first secondary leg 28, and a second secondary leg 30 extending from an angled support member. At the bottoms of the legs on the "T" and the first secondary leg and the second secondary leg is a castor 32, four in total, to allow easy repositioning of the device for practice and storage.

Attached to the junction of the first secondary leg, the second secondary leg and the angled support 34 is a control box 16 mounted proximately to a vertically extending member 38. The control panel of the control box includes an on/off switch 40, a control knob for left breaking balls 42, a control knob for right breaking balls 44, a control knob for top/bottom spin control 46, and a knob for feed speed control 48.

The main frame 12 ends in the vertically extending member 38, the vertically extending member terminating and forming a first dual hinge 18. The hinge members are formed when a first plate 50 attached to the vertically extending member and a second plate 52 attached to the vertically extending member. The dual hinge provides the attachment for the lifting arm 54 to the main frame. The lifting arm includes two elongate members rotatably mounted to the first plate and the second plate in a parallel orientation to each other—an upper elongate member 56 and a lower elongate member 58. The upper elongate member rotates about the first dual hinge at its first end; similarly, the lower elongate member rotates about first dual hinge at its first end. The upper elongate member and the lower elongate member extend substantially parallel to each other, and are attached at their second ends to a second dual hinge member 60. A handle 62 attached to the lifting arm allows easy vertical repositioning of the lifting arm.

The first dual hinge 64 is located proximate an arm lock to secure the elongate arm in a single position, thereby keeping the elongate arm from moving upwardly or downwardly in the vertical direction. While any conventional means of locking would suffice for this function, it is preferred that the lock include a plate in fiction contact with at least one of the elongate arms which can have the amount of friction between the arm and the plate varied by using screw means, or a locking clamp 68, to clamp down on the elongate arms.

Between the main frame and the lifting arm is a compression resistant member 70. The compression resistant member can be an air piston, a hydraulic piston, a spring mechanism, or similar conventional devices. The purpose of the compression resistant member is to provide a degree of resistance to the force of gravity when the lifting arm is moved upwardly. It should provide enough force to allow the ball propelling head 72 and the related mechanisms to stay at a user selected height, yet have enough power to provide some assistance to the user to vertically reposition the height of the propelling head. It should also allow the user to lift the arm with only a minimum of force. It has a first end 74 and a second end 76, the first end attached to the main frame and the second end attached to the lifting arm.

The top end of the lifting arm is a movable vertically extending member 78 forming a second dual hinge. The upper arm and the lower arm are rotatably attached by their respective second ends to form the forth side of the deformable parallelogram. The deformable parallelogram allows the first dual hinge and the second dual hinge to remain substantially parallel while the upper arm and the lower arm of the arm member remain substantially parallel to each other. The second vertically extending member that supports the propelling head 72 remains always perpendicular to the surface the device is mounted on. In other words, this orientation allows the ball impeller to have an unchanging orientation to the surface supporting the apparatus for propelling balls. The movable vertically extending member receives and supports the lifting arm at the second end of the lifting arm.

The second vertically extending member has a mount point for an oscillating bracket rotatable about the vertical axis 80 (shown here by the double headed arrow 81). An aperture defined in the top of the vertically rotatably receives an extension from an oscillating bracket 82 that supports and holds the three driving wheels of the ball propelling device. The oscillating bracket can move freely to allow a motor 86 mounted on the second vertically extending member to move the entire bracket to allow semi-random propelling of the balls. The oscillating bracket has a lower horizontal support 88, a first vertical support 90, a second vertical support 92, and an upper horizontal support 94. It will, of course be appreciated that the oscillating bracket may have only one upwardly extending arm, the main requirement of this arm being that it provide adequate support for the ball reservoir and feeding mechanism. A first rotatable mounting 96 on the first vertical support provides an attachment and pivot point for a ball propulsion device; similarly, a second rotatable mounting 98 on the first vertical support provides an attachment and pivot point for a ball propulsion device. The first and second rotatable mountings provide a mounting that allows the ball propulsion device to be aimed along a vertical arc (shown by the second double headed arrow 100). The vertical mount point allows the oscillating bracket, and the ball propulsion device therein, to be moved along a horizontal arc, and the two rotatable mounting provide means to aim the ball propelled from the ball propulsion device at all radii emanating from the center of a hemisphere defined by the intersection of the horizontal axis and the vertical axis.

The top of the oscillating bracket supports a reservoir 102 of a plurality of tennis balls. A ball delivery guide feeds balls to the ball propulsion device 72. The balls fall under the influence of gravity to a rotating wheel 104 with at least one aperture slightly larger than the diameter of the tennis balls. The driven wheel is powered by a motor mounted on the axis of the rotating wheel.

The falling ball is then guided by the transparent tube 106 to the back of the ball propulsion device. The transparent tube allows the practicing player to see when a ball is about to be launched.

The ball propulsion device includes a head for throwing tennis balls 72 having three wheels 84 aligned at approximately 120° to each other. The ball could be mounted at any angle so long as the three wheels can provide spin in any direction radial to the axis of the propelled balls. Each of the three wheels has a motor 108 that is independently controllable from the control panel 16.

The surface of the wheels of the ball propulsion head 72 have a substantially flat surface. This allows a better grip of the deformable tennis ball for acceleration up to one hundred miles per hour for practicing a serve.

In use the apparatus for propelling balls is controlled by a coach, or similar person to aid the person practicing, who can vary the height of the propelling head by using the lifting arms, vary the aim of the propelling head by using the handle on the oscillating bracket, and vary the spin of the ball propelled from the propelling head by varying the speed of the motors.

Figure 2:
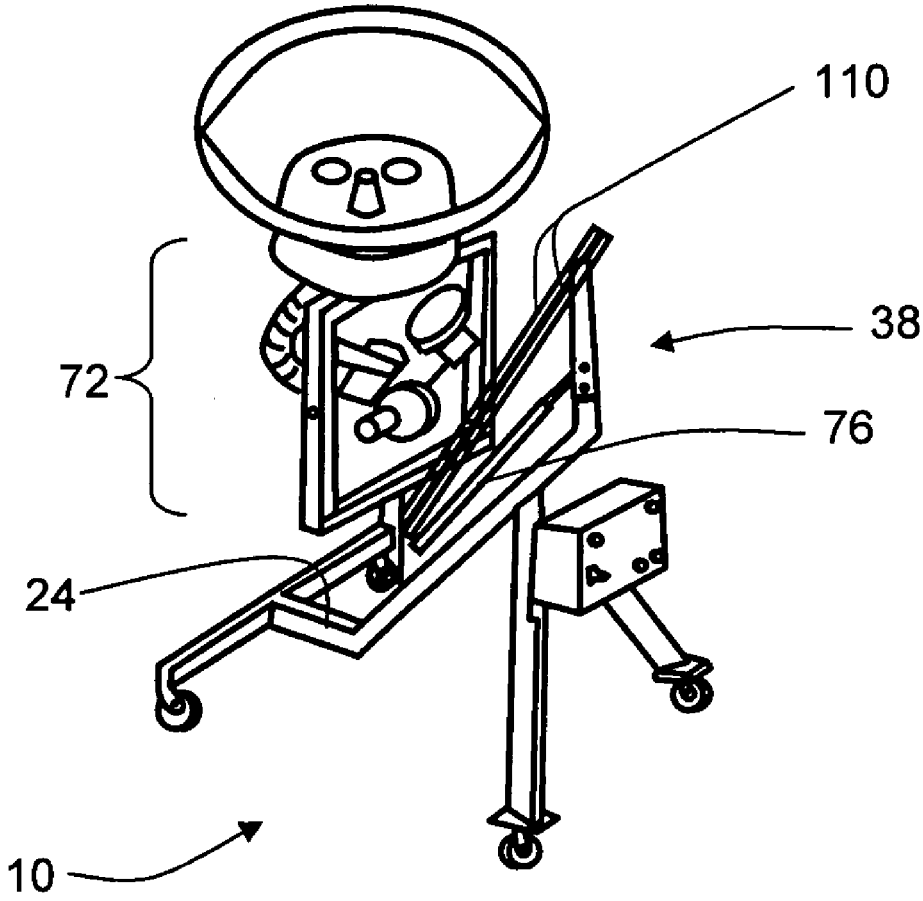
FIG. 2 shows the preferred embodiment of FIG. 1, but the embodiment is fully vertically retracted.

Referring to now to FIG. 2, the device 10 is now in its most vertically retracted position. At the end of a practice session, one would like to be able to stow the device in a reasonable size; therefore, one would like to be able to collapse the device to a small stowable size. The vertical adjustability of the device also allows the balls to be propelled from a variety of vertical heights. The concept of this invention can be used to propel any spherical ball used for playing games, including those used for tennis, volleyball, baseball, handball, racquet ball, and the like. The structure of the device must be made robust enough to propel the ball used in the sport at a speed useful for practicing that game.

Since the point of stowing the device requires movability, the base is preferably movable. The foot plate 24 allows the device to be stabilized while the vertical height is repositioned.

As noted above, the main frame ends in a vertically extending member 38, which terminates in the first dual hinge. Here, the hinge is retracted. The two elongate members 110 rotatably mounted to the first plate are rotated downwardly. The first dual hinge 18 is repositioned by releasing the arm lock 64 and the adjustable arm is repositioned. Then the lock is tightened and the elongate arm is secured in the desired position.

The compression resistant member 76 allows a slow, controlled readjustment of the height of the propelling head 72. It provides a degree of resistance to the force of gravity when the lifting arm is moved upwardly or downwardly.

Because the height of the serving head can be repositioned, one can practice returning serves or volleying.

Figure 3:
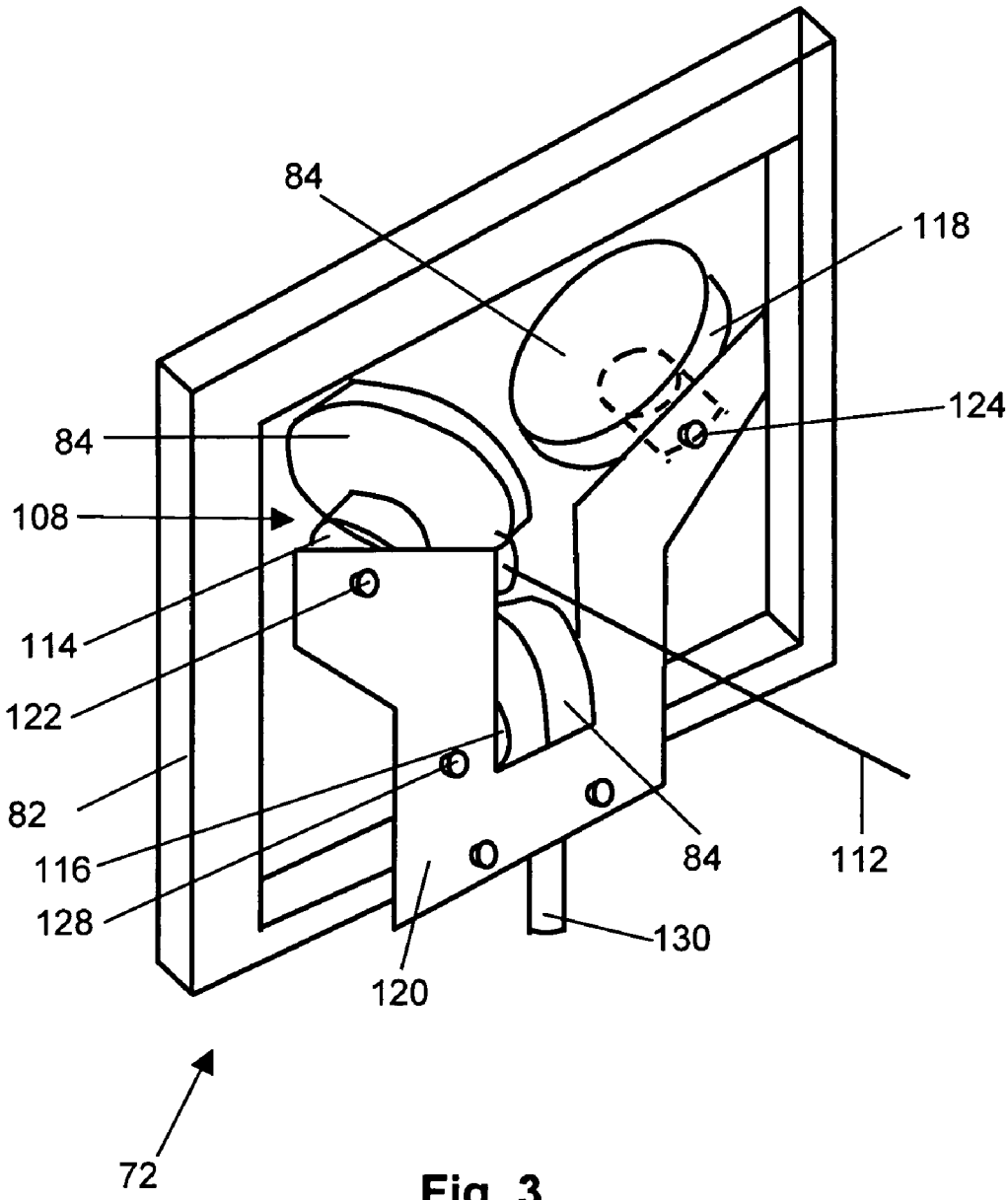
FIG. 3 shows a perspective view of the serving head of the present invention.

Referring to FIG. 3, the serving head 72 of the present invention is preferably a three wheel device. The three wheels 84 are mounted substantially at equal angles to each other about the axis of the motion of the propelled ball 112. The three wheels are rotated by motors 108. Each ball propelling wheel includes one motor for each wheel 114, 116, and 118 (shown in phantom). Each motor can have its speed independently changed to provide various spins to the balls propelled from the head. Each of the motors is mounted on a head mounting bracket 120 that is itself attached to frame. The motors are shown bolted on (only one bolt 122, 124, and 126) is shown for clarity in the drawing—more may be needed in an actual device—and the head mounting bracket is bolted onto the frame. The frame 82 connects on the downward side to the vertically extending member 130 and to the ball feeding device (also not shown in FIG. 3). The motors are in electrical communication with an electric source to power them and in communication with the control box to allow the speed of the motors to be varied.

Typically the motors 108 will rotate at a speed to propel the balls from about twenty miles an hour to about one hundred miles an hour, or for twelve inch wheels from about 500 revolutions per minute (RPMs) to about 3,000 RPMs. The surface of the wheels will be substantially convex. The wheels therefore provide a force to slightly deform the surface of the balls when they pass through the space in between the propelling wheels. This deformation provides better contact with the wheels, which, in turn, allows better grip of the balls and provides faster acceleration of the tennis balls from the propulsion head.

Figure 4:
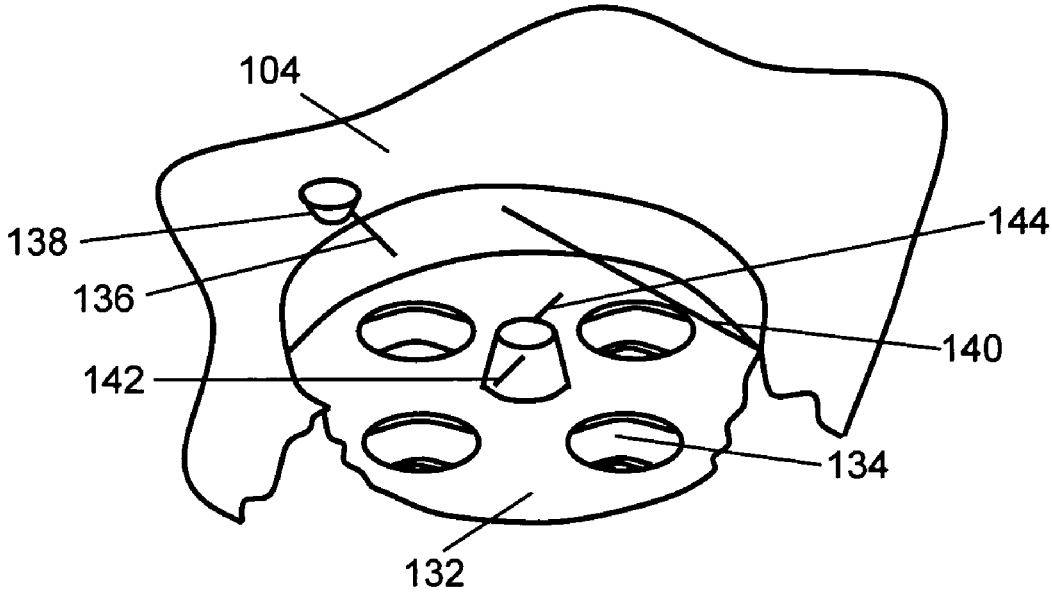
FIG. 4 shows a perspective view of the ball feeder of the preferred embodiment of the present invention.

The tennis balls will be fed from a reservoir 104 of tennis balls mounted on top of the frame member. Referring to FIG. 4, the balls are contained in a reservoir 104 mounted on the top of the tennis ball propelling device, only shown partially in FIG. 4. The balls fall under the influence of gravity into a ball isolating wheel 132. The wheel defines between one and six, preferably four, ball apertures 134 large enough for a tennis ball to fall into. A motor drives the ball isolating wheel and rotates the captured balls around to bottom of the ball tray to a ball feeding tube for presentation to the ball propulsion head. There, the ball falls under the influence of gravity to be fed to the ball propeller head 72 (shown in FIGS. 1, 2, and 3).

One of the great problems with ball feeding of any kind is that the balls tend to jam in the reservoir. To alleviate that situation, here there is a first resilient member 136 supported by a resilient member support 138, to agitate the mass of balls as it passes the first resilient member mounting point. This provides a constant, although not too vigorous, agitation to the mass of balls. A second resilient member 140 stretches across the opening to the ball feeding tube 108. This knocks any ball riding directly on the ball to be fed off allowing only the bal to be fed to fall into the ball feeding tube.

The hub of the ball isolating wheel has two resilient members 142 and 144 mounted thereon to provide agitation and to propel the ball around inside the reservoir. This creates a mass movement of balls that allows the first resilient member to further agitate.

Figure 5:
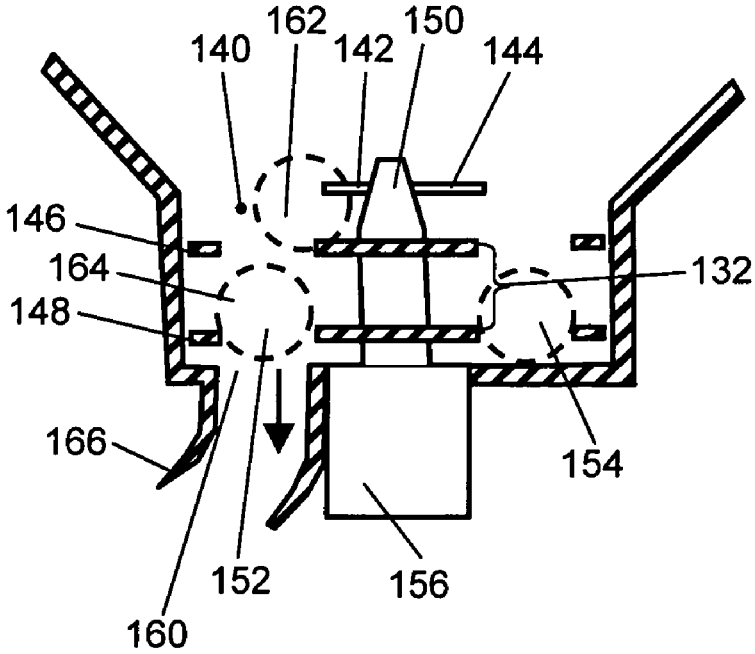
FIG. 5 shows a cut away elevational view of the ball feeder shown in FIG. 4.

In a side view the operation of the second resilient member can be seen more clearly. Referring now to FIG. 5, it can be seen that the ball isolating wheel 132 is a pair of flat members mounted on the rotating hub. The upper flat member 146 and the lower flat member 148 rotate with the motor 156 driven hub 150. Each of the two flat members has apertures defined therein, and the two members are mounted above each other at a distance slightly less than the diameter of a tennis ball. The balls drop into the ball aperture 160 and are rotated to the ball tube feeding aperture. Above the ball tube feeding aperture is the second resilinet member 140 which knocks any ball 162 riding on the ball 164 to be fed off, and allows it to fall into the tube 166 unimpeded.

Figure 6:
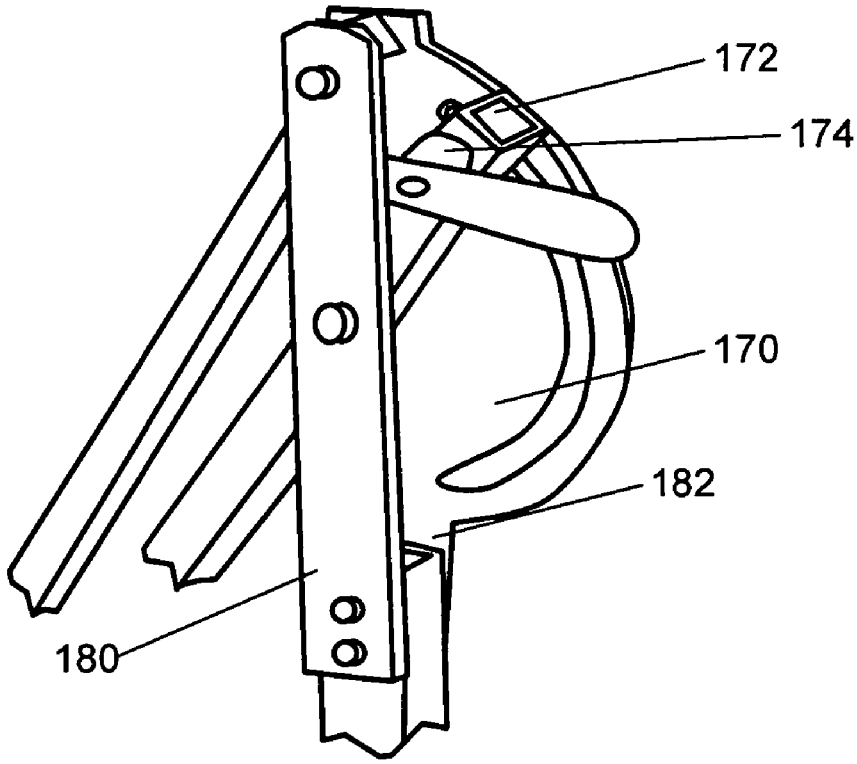
FIG. 6 shows a perspective view of the arm lock of the present invention in the fully retracted position, which is a position substantially similar to the over all position shown in FIG. 2.

The ball propelling head can be moved a substantial distance vertically. To insure that the head does not fall, thereby spoiling the height of the aiming point, and to provide a degree of safety for people located around the apparatus, as stated hereinabove, the first dual hinge also has an arm lock to secure the elongate arm in a single position and keep it from moving upwardly or downwardly in the vertical direction. Referring now to FIG. 6, the preferred lock includes a plate 170 in fiction contact with at least one of the elongate arms 170 which can have the amount of friction between the arm and the plate varied by using screw means, or a locking clamp 174, to clamp down on the elongate arms 172. As shown in FIG. 6, the preferred arm is the lower elongate arm. A bolt or other screw means penetrates the lower elongate arm and penetrates a screw means receiving slot in the friction plate. The screw means is then tightened to secure the elongate arm, and the ball propelling head in one position. The friction plate is preferably an extension and integral with one of the members 180 and 182 forming the vertical support of the first dual hinge.

This invention has been described by reference to specific embodiments and examples thereof. Various modifications, changes and alterations of this invention will naturally suggest themselves to those skilled in the art. It is intended that all such modifications, changes and alterations of the invention be encompassed by the appended claims.

I claim:

1. An apparatus for propelling balls for game practice comprising:

a base member contacting a fixed support member having an integral vertically extending member, the vertically extending member terminating in a first dual hinge;

a lifting arm, including an upper elongate member having a first end and a second end and a lower elongate member having a first end and a second end, the upper elongate member attached to the first dual hinge at a first end and the lower elongate member rotatably attached to the first dual hinge at a first end, the upper elongate member and the lower elongate member mounted substantially parallel to each other;

a compression resistant member having a first end and a second end, the first end attached to the base member and the second end attached to the lower member of the lifting arm;

a movable vertically extending member having a second dual hinge, the second dual hinge rotatably attached to the second end of the upper elongate member and rotatably attached to the second end of the lower elongate member, such that the upper elongate member, the lower elongate member, the first dual hinge and the second dual hinge form a deformable parallelogram that maintains the orientation of the movable vertically extending member relative to the base member;

an oscillating bracket rotatable about the vertical axis attached to the movable vertically extending member;

a ball propulsion device supported by and rotatable about a horizontal axis attached to a serving head support bracket; and a ball delivery guide feeding balls to the ball propulsion device mounted on the serving head support bracket.

2. The apparatus for propelling balls of claim 1 wherein the base member includes a stand including two legs forming a horizontal "T".

3. The apparatus for propelling balls of claim 1 wherein the base member further includes a control box mounted proximate the vertically extending member.

4. The apparatus for propelling balls of claim 1 wherein a control box is in electric communication with a motor driving each one of three propelling motors.

5. The apparatus for propelling balls of claim 1 wherein a control box includes a control for left spin, right spin, and top and bottom spin.

6. The apparatus for propelling balls of claim 1 wherein the balls are impelled by a plurality of driven wheels, further including a control box is in electric communication with each motor that controls the speed of revolution of each one of three propelling motors.

7. The apparatus for propelling balls of claim 1 wherein a control box further includes a control for the feed interval for the ball feed device.

8. The apparatus for propelling balls of claim 1 wherein the base member includes a locking plate attached to the first hinge plate in friction engagement with the upper and lower elongate members.

9. The apparatus for propelling balls of claim 1 wherein the ball propulsion device includes a head for throwing tennis balls.

10. The apparatus for propelling balls of claim 1 wherein the ball propulsion device includes three wheels each independently driven by 3 motors.

11. The apparatus for propelling balls of claim 10 wherein the revolution speed of the three wheels are independently controlled.

12. The apparatus for propelling balls of claim 1 wherein the apparatus further includes at least one handle mounted on an elongate member having two legs forming a horizontal "T".

13. An apparatus for propelling balls for game practice comprising:

a main frame, including an attached control box, having a dual hinge;

a deformable parallelogram lifting arm, having a first end and a second end, attached at its first end to the dual hinge on the main frame;

a movable vertically extending member, rotatably receiving and supported by the second end of the lifting arm at a first end;

an oscillating bracket, disposed at a second end of the movable vertically extending member having at least one upwardly extending arm, rotatable around a vertical axis;

a ball propulsion device mounted on the oscillating bracket to be horizontally rotatable ; and feed support attached to the oscillating bracket above the ball propulsion device providing a source of balls for the ball propulsion device.

14. The apparatus for propelling balls of claim 13 wherein the base member includes a stand including a "T" shaped supporting member.

15. The apparatus for propelling balls of claim 13 wherein the ball propulsion device further includes three ball propelling wheels and the control box is in electric communication with each motor driving each of three ball propelling wheels of the ball propulsion device.

16. The apparatus for propelling balls of claim 13 wherein the base member includes a stand including a "T" shaped supporting member.

17. The apparatus for propelling balls of claim 13 wherein the ball propulsion device further includes a ball isolating wheel and the control box is in electric communication with the motor that controls the speed of revolution of the ball isolating wheel.

18. The apparatus for propelling balls of claim 17 wherein the control box further includes a control for varying the feed interval between balls presented for play of the ball feed device.

19. The apparatus for propelling balls of claim 13 wherein the base member includes a locking plate attached proximate the first hinge plate, said locking plate in friction engagement with at least one of the upper elongate member and the lower elongate members.

20. The apparatus for propelling balls of claim 13 wherein the propulsion head includes a ball propulsion head for presenting tennis balls to a player practicing the game.

21. The apparatus for propelling balls of claim 13 wherein the ball propulsion device includes three ball driving wheels each independently driven a motor dedicated to that particular wheel.

22. The apparatus for propelling balls of claim 13 wherein ball propulsion device further includes three ball propelling wheels and the revolution speed of the three wheels are independently controlled.

23. The apparatus for propelling balls of claim 13 wherein the ball propulsion device further includes at least one handle mounted on an elongate member.

* * * * *